United States Patent [19]

Raccioppi, Jr.

[11] Patent Number: 4,918,966

[45] Date of Patent: Apr. 24, 1990

[54] WORK TABLE FOR SHEET METAL BRAKES

[76] Inventor: Michael G. Raccioppi, Jr., 32 Leswing Ave., Saddle Brook, N.J. 07662

[21] Appl. No.: 396,363

[22] Filed: Aug. 21, 1989

[51] Int. Cl.[5] ..... B21D 5/02; B21D 43/00

[52] U.S. Cl. ..... 72/319; 72/419; 108/1; 108/6

[58] Field of Search ..... 72/319-323, 72/294, 419; 108/6, 1, 8

[56] References Cited

U.S. PATENT DOCUMENTS

| | | | |
|---|---|---|---|
| 127,839 | 6/1872 | Blackburn | 108/1 |
| 274,398 | 3/1883 | Snowden | 72/321 |
| 1,114,677 | 10/1914 | Brooks | 108/6 |
| 1,355,404 | 10/1920 | McKee | 108/1 |
| 1,420,404 | 6/1922 | Beaver | 108/8 |
| 4,364,254 | 12/1982 | Chubb et al. | 72/319 |
| 4,512,174 | 4/1985 | Rhoades | 72/319 |

FOREIGN PATENT DOCUMENTS

| | | | |
|---|---|---|---|
| 29649 | 12/1909 | United Kingdom | 108/6 |

*Primary Examiner*—Daniel C. Crane
*Attorney, Agent, or Firm*—Samuelson & Jacob

[57] ABSTRACT

A work table for use in connection with a sheet metal brake is mounted on the frame of the sheet metal brake for swinging movement between a first position, where the table extends over the clamp of the brake to provide a convenient work surface for the preparation of a sheet of metal to be bent in the brake, and a second position, where the table is swung away from the clamp to enable access to the clamp for subsequent bending of the prepared sheet of metal, and is arranged to be biased by gravity into selective retention at either of the first and second positions.

14 Claims, 2 Drawing Sheets

WORK TABLE FOR SHEET METAL BRAKES

The present invention relates generally to work tables and pertains, more specifically, to a work table constructed for attachment to a sheet metal brake to provide a convenient work surface for facilitating the preparation of a sheet of metal for subsequent bending in the sheet metal brake.

Sheet metal brakes are available in a wide variety of configurations for serving many different uses where sheet metal must be bent into a prescribed shape. Portable sheet metal brakes are used extensively for setting up temporary work stations at remote work sites where sheet metal parts will be fabricated for immediate use. For example, in the cutting and fitting of aluminum siding components or aluminum gutters, an installer will set up a temporary work station adjacent the building where the installation is taking place and utilize a sheet metal brake for fabricating the required components in the field. Frequently, sheets of metal at such sites are cut from rolls of sheet metal of indeterminate length, and the sheets are then placed in the sheet metal brake for bending. Since work space usually is limited at these sites and since it is desirable to minimize the number of pieces of equipment which must be brought to a remote work station, it would be advantageous to have available a compact, portable, convenient-to-use work table for facilitating the preparation of the sheets of metal for subsequent bending in the sheet metal brake.

The present invention provides a convenient, compact, portable work table for use in connection with a sheet metal brake at a work station located at a remote work site and attains several objects and advantages, some of which may be summarized as follows: Provides a convenient work surface for effective use in the field at a single work station so that sheets of metal are prepared easily for ready subsequent bending in a sheet metal brake; enables ease of transport to and set-up at a remote work site for effective use at the site; provides simplified design and construction for economical manufacture and ease of installation and use; places a work surface at an ergonomically best-suited location for effective use in connection with sheet metal bending operations in the field; enables unobtrusive installation of a work table for effective use in connection with any one of a variety of currently available portable metal bending brakes, enhancing the function of the metal bending brake in the field; provides an economical construction capable of relatively inexpensive manufacture for encouraging widespread use.

The above objects and advantages, as well as further objects and advantages, are attained by the present invention which may be described briefly as a work table for use in connection with a sheet metal brake having a frame, a clamp extending longitudinally along the frame, and bending means for bending a sheet of metal about a longitudinal bend line while the sheet of metal is held in the clamp, the work table comprising: a table top extending in a longitudinal direction; bracket means for mounting the table top upon the frame of the sheet metal brake such that the table top is located above the clamp and the longitudinal direction of the table top is aligned generally parallel to the longitudinal bend line; and movable means coupling the table top with the bracket means for movement of the table top between a first position wherein the table top is essentially horizontal and will overlie the clamp to provide an essentially horizontal work surface for the preparation of the sheet of metal to be bent, and a second position wherein the table top is moved away from the clamp to expose the clamp for use in concert with the bending means for bending the prepared sheet of metal.

The invention will be understood more fully, while still further objects and advantages will become apparent, in the following detailed description of a preferred embodiment of the invention illustrated in the accompanying drawing, in which.

Figure 1:
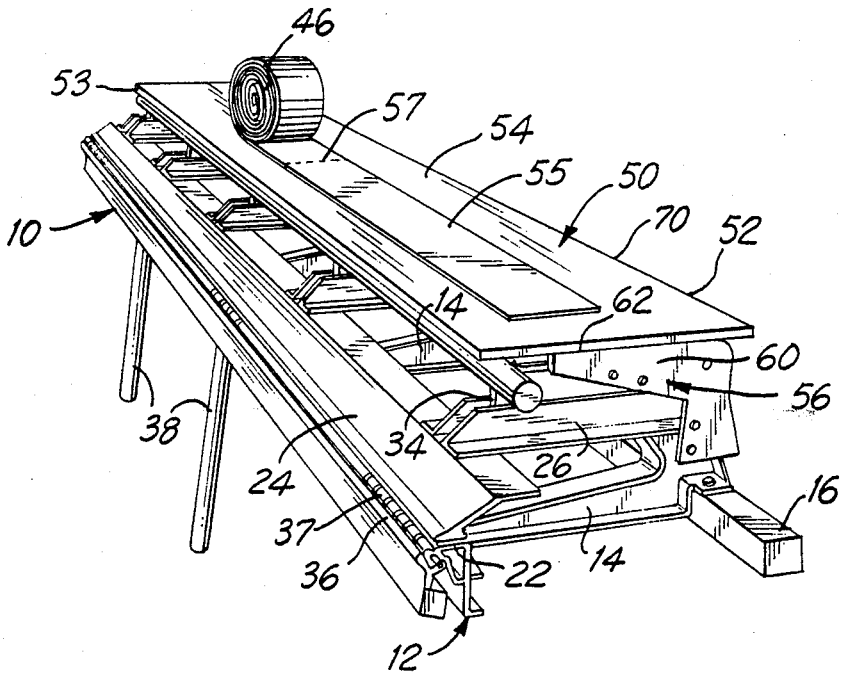
FIG. 1 is a perspective view of a sheet metal brake to which there is attached a work table constructed in accordance with the present invention.
Figure 2:
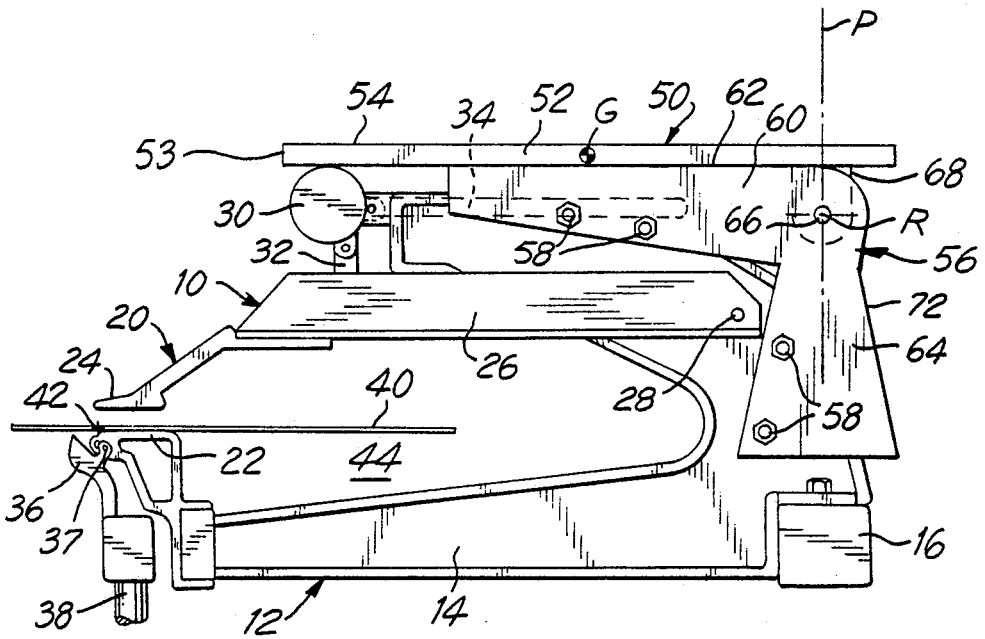
FIG. 2 is an enlarged end elevational view of a portion of the sheet metal brake with the work table attached.

Referring now to the drawing, and especially to FIGS. 1 and 2 thereof, a typical sheet metal brake is illustrated at 10 and is seen to include a frame 12 having a plurality of essentially C-shaped frame members 14 mounted on a support bed 16, which constitutes a part of the frame 12. A clamp 20 carried by the frame 12 includes a lower jaw 22, fixed to the frame 12 and extending in a longitudinal direction along the frame 12, and an upper jaw 24 carried by plurality of clamp arms 26 to extend longitudinally along the frame 12, the clamp arms 26 being mounted upon frame 12 for transverse swinging movement relative to the frame 12 by means of pins 28 passing through the clamp arms 26 and the frame members 14, such that the upper jaw 24 is selectively movable toward and away from the fixed lower jaw 22. An actuator rod 30 is linked to the frame 12 and to the clamp arms 26 by linkages 32, and a clamp handle 34 is carried by the actuator rod 30 for selective rotation of the actuator rod 30 by an operator (not shown) to swing the clamp arms 26 and thereby move the upper jaw 24 into and out of clamping engagement with the lower jaw 22, all in a manner now well known in the art of sheet metal brakes. A bending bar 36 is hinged to the lower jaw 22 at 37 and carries bending handles 38, for bending sheet metal held in the clamp 20, as will be explained in further detail below.

Figure 4:
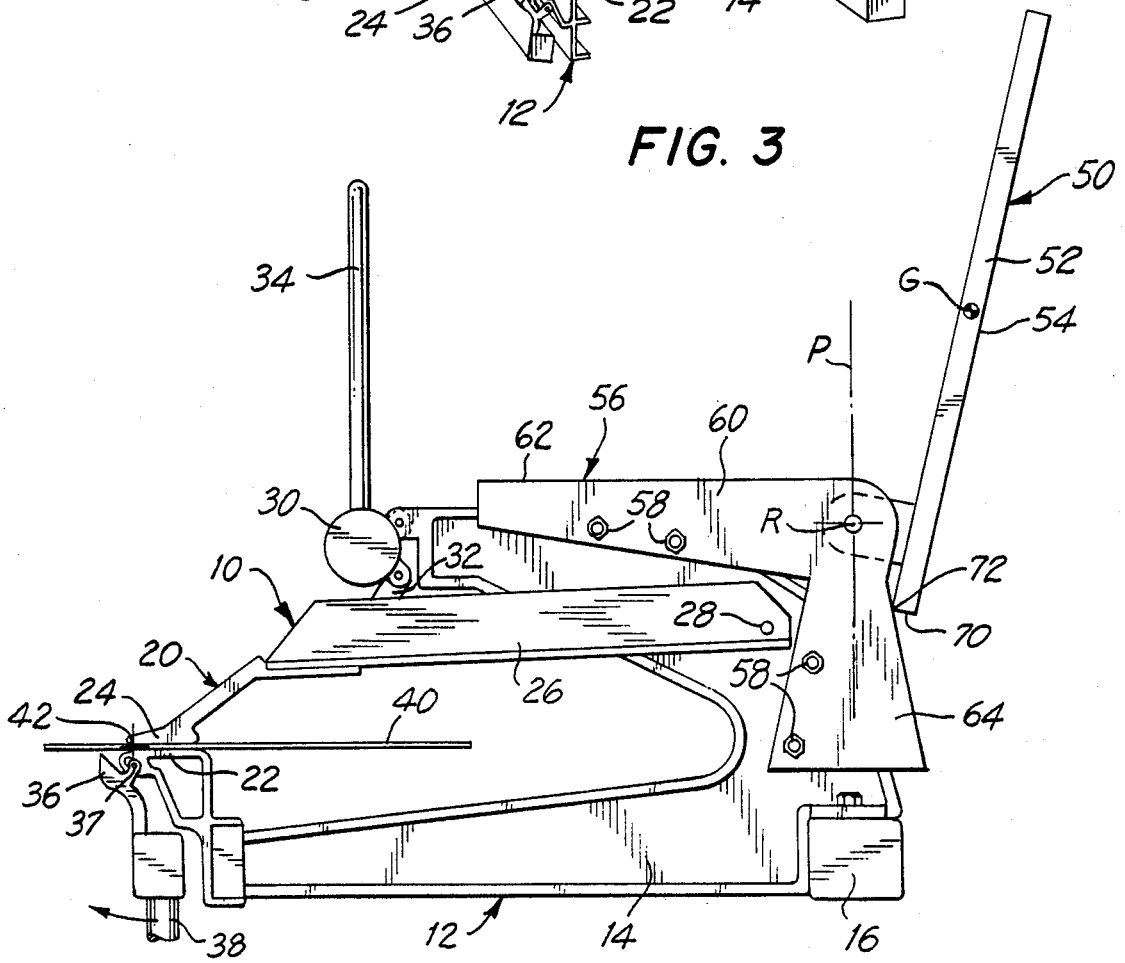
FIG. 4 is an enlarged end elevational view similar to FIG. 2 with component parts and the work table is another position.

In utilizing the sheet metal brake 10 in the field, a sheet of metal is inserted laterally into the open clamp 20, as illustrated at 40 in FIG. 2, and is located appropriately relative to a longitudinal bend line, the trace of which bend line is shown at 42, the lateral width of the sheet of metal 40 being accommodated within the clamp 20 by virtue of the bight 44 provided by the C-shaped configuration of the clamp frame members 14. Once the sheet of metal 40 is properly located within the clamp 20, the clamp 20 is closed by swinging the clamp handle 34 to rotate the actuator rod 30, as seen in FIG. 4, and bring the upper jaw 24 toward the lower jaw 22 until the sheet of metal 40 is clamped in place, as illustrated in FIG. 4. Subsequently, the bending bar 36 is swung upwardly to operate in concert with clamp 20 to bend the sheet of metal 40 about the bend line 42, as is well known in metal bending brakes.

Usually, the sheet of metal 40 is prepared for insertion into the brake 10 by cutting the sheet of metal 40 from a source of stock sheet metal maintained nearby, one of the more common sources being illustrated in the form of a roll 46 of sheet metal from which the sheet of metal 40 has ben severed. Such preparation generally is carried out at another work station separate from the work station at which the sheet metal brake 10 is located, sometimes on a free-standing work table, and very often merely on the ground. As a result, an operator must shuttle between work stations each time a sheet of metal 40 is to be bent and, in the case of preparation on the ground, must himself bend into an awkward and uncomfortable position while preparing the sheet of metal 40 for removal to the sheet metal brake 10, thus affecting his ability to execute the operation with accuracy as well as to continue for long periods without excessive fatigue. The use of a separate work table, while increasing accuracy and tending to decrease fatigue, requires that additional equipment be carried to the site and be erected in the field, taking up more space at the site, where space may be limited, as well as during transportation, where space is restricted.

The present invention comprises a work table adapted for integration with currently available sheet metal brakes, such as sheet metal brake 10, to provide a convenient work surface for the preparation of a sheet of metal for bending in the sheet metal brake. Thus, as seen in the drawing, a work table 50 includes a table top 52 extending in a longitudinal direction and mounted upon the frame 12 of the metal bending brake 10 so that the longitudinal direction is aligned essentially parallel with the longitudinal bend line 42 and the table top 52 extends laterally over the clamp 20 of the brake 10 toward the position of the operator so that the forward edge 53 of the table top 52 is adjacent the operator and the table top 52 itself overlies the clamp 20 to provide a convenient work surface 54 for the preparation of the sheet of metal 40. Thus, as seen in FIG. 1, a length 55 of sheet metal is rolled out from the adjacent roll 46 of stock sheet metal directly onto the work surface 54 of the table top 52, thereby placing the length 55 of sheet metal immediately in front of the operator for ease of cutting sheet of metal 40 from the indeterminate length provided by the roll 46, as illustrated by cut line 57. Once cut, the prepared sheet of metal 40 merely is moved laterally forward, toward the operator, and off the work surface 54 for direct transfer and placement between the open lower and upper jaws 22 and 24 of the clamp 20.

Table top 52 is mounted upon the frame 12 of sheet metal brake 10 by means of at least a pair of L-shaped brackets 56 which are secured to the frame 12 by threaded fasteners in the form of bolts 58 passing through the brackets 56 and corresponding clamp frame members 14 to affix the brackets 56 in place. Each bracket 56 includes a first support arm 60, which extends laterally and provides a generally horizontal support surface 62, when the bracket 56 is appropriately secured to the corresponding clamp frame member 14, and a second support arm 64, which extends transversely and provides a generally vertical support, when the bracket 56 is secured to the clamp frame member 14. Table top 52 is coupled with the brackets 56 for swinging movement relative to the brackets 56 by means of a pivot shaft 66 which passes through each bracket 56 and is journaled within depending legs 68 integral with the table top 52 at locations spaced longitudinally along the table top 52.

Figure 3:
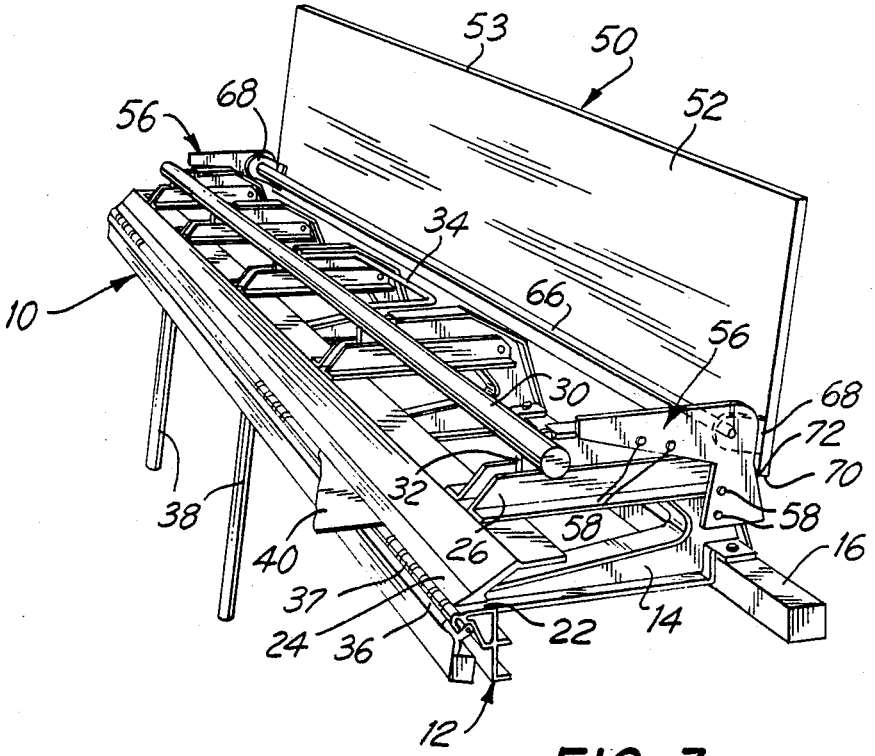
FIG. 3 is a perspective view similar to FIG. 1 with the work table in another position.

As depicted in FIGS. 1 and 2, table top 52 is located in a first position, in which the table top 52 is supported upon the support surface 62 of each bracket 56, each support surface 62 serving as a stop surface defining the first position, so that the table top 52 extends laterally and the work surface 54 is essentially horizontal and placed appropriately for the preparation of sheet of metal 40, as described above. Once the sheet of metal 40 is prepared and then located between the lower and upper jaws 22 and 24 of clamp 20, the table top 52 is swung by the operator to a second position, depicted in FIGS. 3 and 4, in which the table top 52 is moved away from the clamp 20 to expose the actuator rod 30 and the clamp handle 34 for actuation of the upper jaw 24 of the clamp 20 to close the clamp 20 and grip the sheet of metal 40 in place within the brake 10 for subsequent bending along the bend line 42. In the second position, the rearward edge 70 of the table top 52 is abutted against a stop surface 72 on the support arm 64 to define the second position of the table top 52. The placement of the pivot shaft 66 relative to the table top 52, the horizontal support surface 62 and the stop surface 72 enables the table top 52 to be biased into and to be retained selectively in either one of the first position and the second position by gravity so that the table top 52 remains in the first position during preparation of the sheet of metal 40 and in the second position until the operator completes the bending operation and then returns the table top 52 to the first position for the preparation of the next sheet of metal. Thus, the table top 52, when in the first position, extends in a generally horizontal orientation, with the center of gravity G of the table top 52 located forward of the vertical plane P passing through the axis of rotation R established by the pivot shaft 66 so that the table top 52 is biased by gravity to remain in the first position, and when in the second position, extends upwardly in a generally vertical orientation, with the center of gravity G of the table top 52 located rearward of the vertical plane P so that the table top 52 is biased by gravity to remain in the second position. Preferably, axis of rotation R is essentially parallel to bend line 42.

Work table 50 is adapted readily to a variety of existing sheet metal brakes, merely by the proper location and securement of the brackets 56. Where the table top 52 is exceptionally long, several brackets 56 may be located along the length of the table 50 to provide as many brackets 56 as may be required for sufficient support and the table top 52 may be coupled to all of the brackets 56 by a corresponding number of depending legs 68. The construction of the work table 50 is such that operation of the sheet metal brake is in no way impaired, while the work surface 54 is placed for convenient use. Thus, the work table 50 attains several objects and advantages, some of which are as follows: Provides a convenient work surface for effective use in the field at a single work station so that sheets of metal are prepared easily for ready subsequent bending in a sheet metal brake; enables ease of transport to and set-up at a remote work site for effective use at the site; provides simplified design and construction for economical manufacture and ease of installation and use; places a work surface at an ergonomically best-suited location for effective use in connection with sheet metal bending operations in the field; enables unobtrusive installation of a work table for effective use in connection with any one of a variety of currently available portable metal bending brakes, enhancing the function of the metal bending brake in the field; provides an economical construction capable of relatively inexpensive manufacture for encouraging widespread use.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A work table for use in connection with a sheet metal brake having a frame, a clamp extending longitudinally along the frame, and bending means for bending a sheet of metal about a longitudinal bend line when the sheet of metal is held in the clamp, the work table comprising:

a table top extending in a longitudinal direction and having opposite surfaces;

bracket means for mounting the table top upon the frame of the sheet metal brake such that the table top is located above the clamp and the longitudinal direction of the table top is aligned generally parallel to the longitudinal bend line, the bracket means including a support arm extending laterally along the bracket means and providing a generally horizontal support surface for the table top when the bracket means is secured to the frame of the sheet metal brake;

securing means for securing the bracket means to the frame in fixed relationship therewith; and movable means coupling the table top with the bracket means for movement of the table top relative to the bracket means between a first position wherein the table top is essentially horizontal and one surface of said table top will rest upon the support surface provided by the support arm of the bracket means to overlie the clamp so that the opposite surface of said table top provides an essentially horizontal work surface for the preparation of the sheet of metal to be bent, and a second position wherein the table top is moved away from the clamp to expose the clamp for use in concert with the bending means for bending the prepared sheet of metal;

the bracket means further including means for defining the second position of the table top, said second position being established by said bracket means and one surface of said table top.

2. The invention of claim 1 wherein the means for defining the second position of the table top includes stop means on the bracket means.

3. The invention of claim 2 wherein the relative location of the support surface, the stop means and the pivot means is such that the table top is biased by gravity selectively toward either one of the first position and the second position when the securing means secures the bracket means to the frame.

4. The invention of claim 1 wherein the movable means includes pivot means coupling the table top with the bracket means for pivotal movement between the first position and the second position so that the table top is swung away from the clamp when in the second position.

5. The invention of claim 4 wherein the pivot means includes an axis of rotation about which the table top is swung between the first and second positions, and the axis of rotation is essentially parallel to the longitudinal bend line.

6. The invention of claim 5 wherein the table top includes a center of gravity located forward of a vertical plane passing through the axis of rotation when the table top is in the first position and located rearward of the vertical plane when the table top is in the second position.

7. The invention of claim 1 wherein the bracket means includes at least one pair of brackets spaced apart longitudinally, and securing means associated with the brackets for selectively securing each bracket to the frame of the sheet metal brake.

8. The invention of claim 7 wherein the securing means includes threaded fasteners located so as to enable fastening to the existing structure of the frame.

9. The invention of claim 1 wherein the clamp includes actuator means placed at a convenient location for operation by an operator, and the table top includes a forward edge spaced laterally from the movable means a sufficient distance to assure that the table top overlies the convenient location, when in the first position, to place the work surface at a corresponding convenient location relative to the operator when the securing means secures the bracket means to the frame.

10. The invention of claim 9 wherein the second position of the work table is such that the actuator means is exposed for actuation by an operator when the work table is in the second position.

11. The invention of claim 10 wherein the movable means includes pivot means coupling the table top with the bracket means for pivotal movement between the first position and the second position so that the table top is swung away from the clamp when in the second position.

12. The invention of claim 11 wherein the pivot means includes an axis of rotation about which the table top is swung between the first and second positions, and the axis of rotation is essentially parallel to the longitudinal bend line.

13. The invention of claim 12 wherein the table top includes a center of gravity located forward of a vertical plane passing through the axis of rotation when the table top is in the first position and located rearward of the vertical plane when the table top is in the second position.

14. The invention of claim 13 wherein the bracket means includes at least one pair of brackets spaced apart longitudinally, and securing means associated with the brackets for selectively securing each bracket to the frame of the sheet metal brake.

* * * * *